US006510920B1

(12) United States Patent
Durand

(10) Patent No.: US 6,510,920 B1
(45) Date of Patent: Jan. 28, 2003

(54) VEHICLE EXHAUST SYSTEM AND METHOD OF MANUFACTURE

(75) Inventor: Robert D. Durand, Reading, PA (US)

(73) Assignee: Dana Corporation, Toledo, OH (US)

( * ) Notice: Subject to any disclaimer, the term of this patent is extended or adjusted under 35 U.S.C. 154(b) by 54 days.

(21) Appl. No.: 09/652,482

(22) Filed: Aug. 31, 2000

Related U.S. Application Data

(60) Provisional application No. 60/151,786, filed on Aug. 31, 1999.

(51) Int. Cl.[7] ..... F01N 1/02
(52) U.S. Cl. ..... 181/249
(58) Field of Search ..... 181/227, 228, 181/249, 243, 282

(56) References Cited

U.S. PATENT DOCUMENTS

| | | | | |
|---|---|---|---|---|
| 3,794,805 A | | 2/1974 | Rudd | |
| 5,058,381 A | * | 10/1991 | Christianson et al. | 181/243 |
| 5,170,020 A | * | 12/1992 | Kruger et al. | 181/211 |
| 5,448,831 A | | 9/1995 | Harwood | |
| 5,475,911 A | | 12/1995 | Wells et al. | |
| 5,481,892 A | | 1/1996 | Roper et al. | |
| 5,485,737 A | | 1/1996 | Dickerson | |
| 5,491,883 A | | 2/1996 | Marlinga | |
| 6,052,991 A | * | 4/2000 | Schneider et al. | 181/228 |
| 6,082,487 A | * | 7/2000 | Angelo et al. | 181/256 |

* cited by examiner

*Primary Examiner*—Robert E. Nappi
*Assistant Examiner*—Kim Lockett
(74) *Attorney, Agent, or Firm*—MacMillan, Sobanski & Todd, LLC

(57) ABSTRACT

A vehicular vehicle exhaust system and method for manufacturing same using hydroforming and magnetic impulse welding techniques is disclosed. An exhaust system of the invention includes a flange adapted for connection to an exhaust manifold of an engine of a vehicle, a first exhaust tube having a first end connected to the flange and a second end expanded to form a first portion of a chamber, and a second exhaust tube having a first end expanded to form a second portion of a chamber closure and a second end open to atmosphere. The end portions of the first and second tubes may be formed to desired shapes using a hydroforming process. The second portion of the chamber is sized to fit inside the first portion of the chamber and can be secured thereto by magnetic pulse welding techniques. The exhaust system can further include a retainer tube that is connected to the first and second tubes by magnetic pulse welding techniques.

21 Claims, 7 Drawing Sheets

VEHICLE EXHAUST SYSTEM AND METHOD OF MANUFACTURE

CROSS REFERENCE TO RELATED APPLICATION

This application claims the benefit of U.S. Provisional Application No. 60/151,786, filed Aug. 31, 1999, the disclosure of which is incorporated herein by reference.

BACKGROUND OF THE INVENTION

This invention relates in general to the manufacture and assembly of a vehicular exhaust system. More specifically, the invention relates to an improved structure and method for manufacturing a vehicular exhaust system using hydroforming and magnetic pulse welding techniques.

Virtually all vehicles, aircraft, and boats are powered by a fuel-burning engine and include an exhaust system that carries post combustion gaseous materials from the engine to a point removed from the passenger compartment. A typical basic exhaust system includes a metallic tube having a first end that is connected to an exhaust manifold provided on the engine and a second end extending outwardly from the lower rear end of the vehicle. Thus, the exhaust tube carries the post combustion gaseous materials from the engine to the exterior of the vehicle. Because of space constraints beneath the vehicle, such exhaust tubes are often bent at one or more locations to fit within the available space.

Frequently, these exhaust tubes include a structure for reducing the magnitude of the noise generated by the engine and for reducing the amount of post combustion products that are exhausted to the atmosphere, such as a muffler or a catalytic converter. A typical muffler or catalytic converter includes a pair of internal conduits that are supported by transversely extending baffles within a closed chamber. The chamber is usually formed from one or more sheets of metal that are stamped or otherwise deformed and secured together to provide a desired shape. The chamber normally has an inpening that is connected to a first tube-extending from the exhaust manifold to receive the post combustion products from the engine and an output opening that is connected to a second tube extending to a point removed from the passenger compartment. The physical arrangement of the baffles within the muffler chamber contributes to noise attenuation. Additionally, sound deadening materials and/or catalytic chemical materials may be provided within the chamber for reducing the magnitude of the noise generated by the engine and for reducing the amount of post combustion products that are exhausted to the atmosphere.

Known muffler designs generally involve a relatively large number of components that are assembled in a relatively labor intensive process. As mentioned above, the tubes are often bent in a plurality of locations. Furthermore, several of such tubes may be connected together by mechanical clamps or by welding. When weight is a consideration and the components are formed from aluminum or aluminum alloy materials, inert gas welding may be necessary to assure reliable welds. Also, sharp bends in the exhaust system are often created by welding relatively straight sections together. This creates sharp angles that may amplify sounds in certain frequency ranges. In addition, the chamber, as mentioned above, is frequently fabricated from plurality of stamped pieces or formed sheet metal. Assembly of such components requires welding seams and/or end pieces in addition to welding a variety of interior tubes. Generally, this results in additional labor intensive manufacturing steps. In addition, the parallel walls of such chambers and sharp comers decrease can noise attenuation and may create secondary noise.

As is well known, conventional welding techniques involve the application of heat to localized areas of two metallic members. This results in a coalescence of the two metallic members. Such welding may or may not be performed with the application of pressure, and may or may not include the use of a filler metal. Although conventional welding techniques have functioned satisfactorily in the past, there are some drawbacks in using them to join exhaust components together. First, as noted above, conventional welding techniques involve the application of heat to localized areas of the exhaust system. This application of heat can introduce undesirable distortions and weaknesses into the metallic components. Second, while conventional welding techniques are well suited for joining components that are formed from similar metallic materials, it has been found to be somewhat more difficult to adapt them for use in joining components formed from dissimilar metallic materials. Third, conventional welding techniques may not be easily adapted for joining components which have a different gauge thickness.

The production of vehicle exhaust systems is usually a high volume, low margin process and any improved structure and method of assembling a vehicle exhaust assembly would be advantageous. Thus, it would be desirable to provide an improved structure for a vehicle exhaust system and method of manufacturing same that is relatively simple and inexpensive.

SUMMARY OF THE INVENTION

This invention relates to an improved structure for a vehicle exhaust system and method for manufacturing same using hydroforming and magnetic impulse welding techniques. An exhaust system of the invention includes a flange adapted for connection to an exhaust manifold of an engine of a vehicle, a first exhaust tube having a first end connected to the flange and a second end expanded to form a first portion of a chamber, and a second exhaust tube having a first end expanded to form a second portion of a chamber closure and a second end open to atmosphere. The end portions of the first and second tubes may be formed to desired shapes using a hydroforming process. The second portion of the chamber is sized to fit inside the first portion of the chamber and can be secured thereto by magnetic pulse welding techniques. The exhaust system can further include a retainer tube that is connected to the first and second tubes by magnetic pulse welding techniques. A method of the invention for manufacturing a vehicle exhaust system includes the steps of pre-bending a first exhaust tube having a first end and a second end, pre-bending a second exhaust tube having a first end and a second end, hydroforming the second end of the first exhaust tube and the first end of the second exhaust tube to form an complementary shapes, and securing the ends of the exhaust tubes together using magnetic pulse weld techniques. The me d can also include the steps of securing a retainer tube to the first and second tube using magnetic pulse welding techniques.

Various objects and advantages of this invention will become apparent to those skilled in the art from the following detailed description of the preferred embodiments, when read in light of the accompanying drawings.

DETAILED DESCRIPTION OF THE PREFERRED EMBODIMENT

Figure 1:
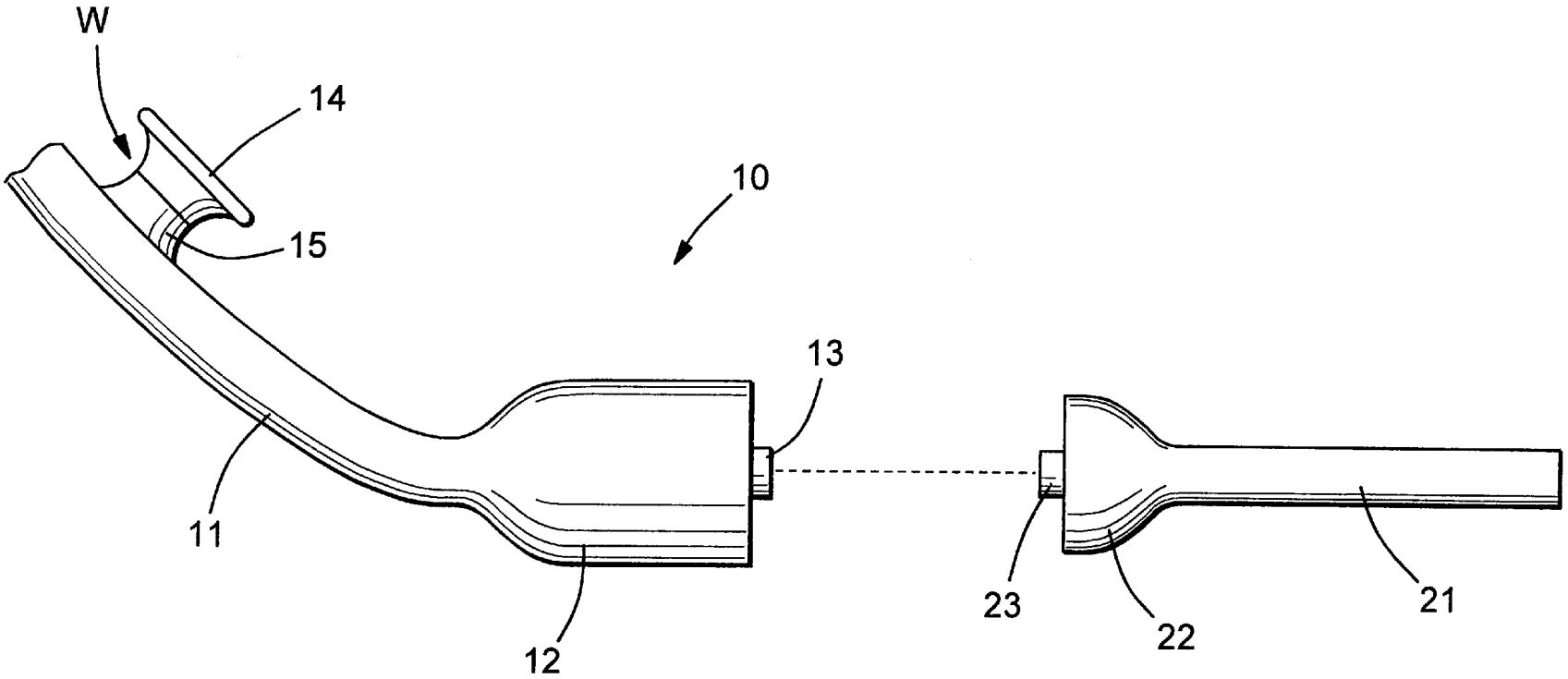
FIG. 1 is an exploded side elevational view of a vehicle exhaust system in accordance with the structure and method of manufacture of this invention.

Referring to the drawings, there is illustrated in FIG. 1 a vehicle exhaust system, indicated generally at 10, in accordance with this invention. The vehicle exhaust system 10 includes a first tube 11 having an enlarged end portion 12 that, as will be described below, is adapted to form a first portion of an exhaust chamber. A first retainer tube 13 is disposed within the enlarged end portion 12 and communicates with the first tube 11 in the manner described below. The first tube 11 may have one or more connection flanges 14 (only one is illustrated) connected thereto by means of respective mounting surfaces 15. The connection flanges 14 may be provided to connect the first tube to an exhaust manifold (not shown) or other portion of an engine or similar source of power for the vehicle in a known manner. The mounting surface 15 may be secured to the connection flange 14 by magnetic pulse welding, such as shown at W in FIG. 1, in the manner described below. The structure and method of manufacture of the flanges 14 and the mounting surfaces 15 will be discussed below. The vehicle exhaust system 10 further includes a second tube 21 having an enlarged end portion 22 that, as will be described below, is adapted to form a second portion of the exhaust chamber. A second retainer tube 23 is disposed within the enlarged end portion 22 and communicates with the second tube 21 in the manner described below.

Figure 2:
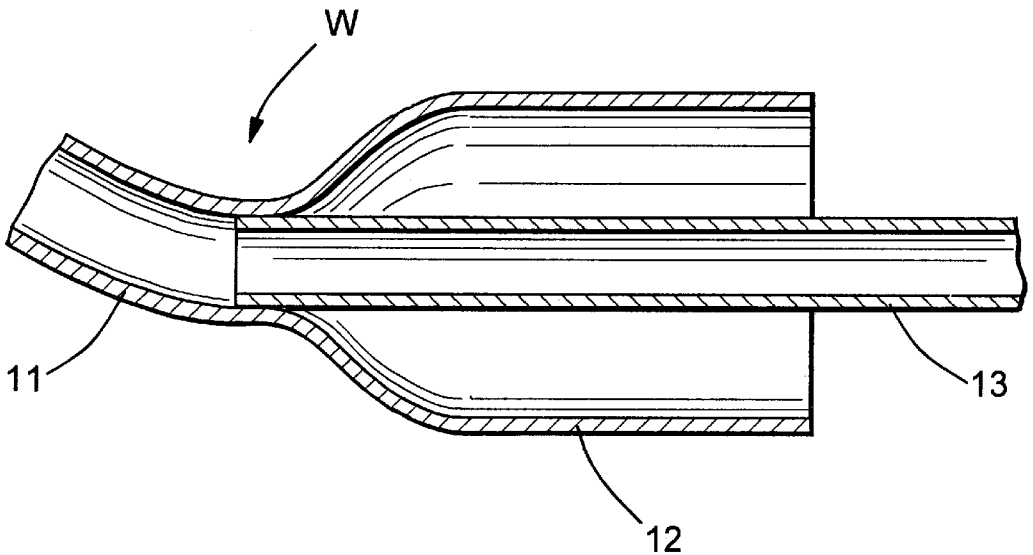
FIG. 2 is a sectional elevational view of a portion of a first portion of the vehicle exhaust system illustrated in FIG. 1.
Figure 3:
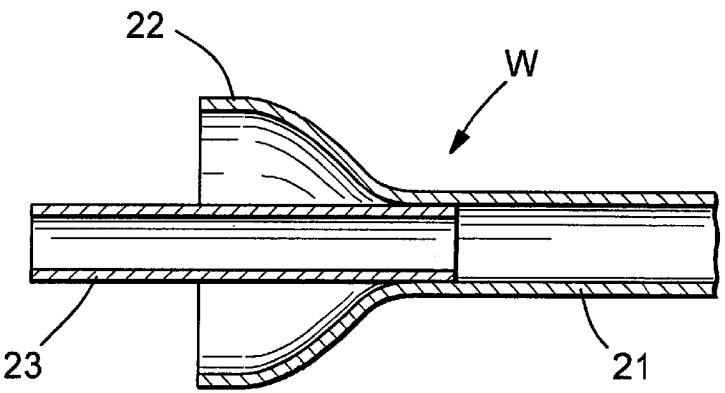
FIG. 3 is a sectional elevational view of a portion of a second portion of the vehicle exhaust system illustrated in FIG. 1.

The structures of the enlarged end portions 12 and 22 of the first and second tubes 11 and 12 are shown in greater detail in FIGS. 2 and 3. As shown in FIG. 2, the enlarged end portion 12 of the first tube 11 is generally hollow and cylindrical in shape and terminates in a generally circular end surface. However, the enlarged end portion 12 of the first tube 11 may be formed having any desired shape. The first retainer tube 13 extends within the enlarged end portion 12 and is secured to the first tube 11 in the manner described below. Thus, a fluid conduit is provided from the first tube 11 through the first retainer tube 13. The first retainer tube 13 may be secured to the first tube 11 by magnetic pulse welding, such as shown at W in FIG. 2, in the manner described below. Similarly, as shown in FIG. 3, the enlarged end portion 22 of the second tube 21 is generally hollow and cylindrical in shape and terminates in a generally circular end surface. However, the enlarged end portion 22 of the second tube 21 may be formed having any desired shape. The second retainer tube 23 extends within the enlarged end portion 22 and is secured to the second tube 21 in the manner described below. Thus, a fluid conduit is provided from the second retainer tube 23 through the second tube 21. The second retainer tube 23 may be secured to the second tube 21 by magnetic pulse welding, such as shown at W in FIG. 3, also in the manner described below.

Figure 4:
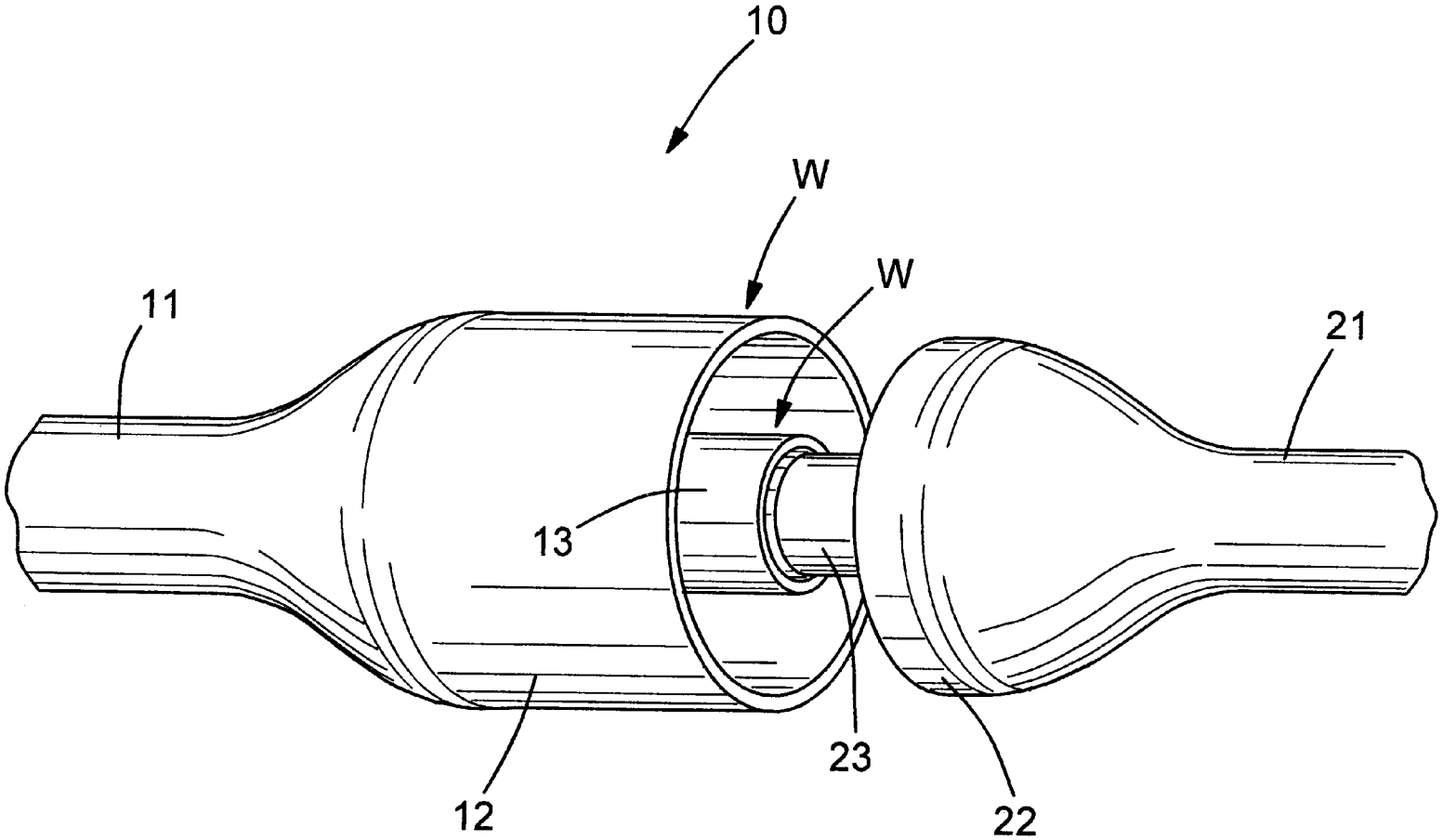
FIG. 4 is an enlarged perspective view of a portion of the vehicle exhaust system illustrated in FIG. 1 shown partially assembled.

Preferably, the end surfaces of the first and second enlarged end portions 12 and 22 are complementary in shape to facilitate their securement together in the manner described below to form the exhaust chamber. Furthermore, as will be explained below, one of the end surfaces of the first and second enlarged end portions 12 and 22 is preferably formed slightly smaller in size than the other one of such end surfaces. As a result, one of the first and second enlarged end portions 12 and 22 can be disposed telescopically within the other, for a reason that will be explained below. Similarly, the first and second retainer tubes 13 and 23 are preferably complementary in shape to facilitate their securement together in the manner described below. Furthermore, as will be explained below, one of the first and second retainer tubes 13 and 23 is preferably formed slightly smaller in size than the other one of such retainer tubes 13 and 23. As a result, one of the first and second retainer tubes 13 and 23 can be disposed telescopically within the other, as shown in FIG. 4, for a reason that will be explained below.

Figure 5:
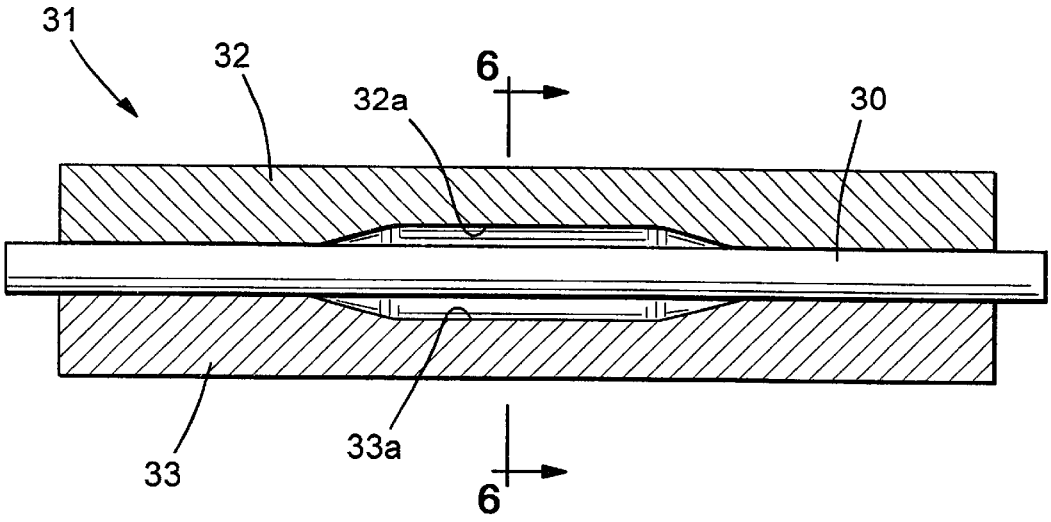
FIG. 5 is a sectional elevational view of a hydroforming die containing an exhaust tube blank shown prior to expansion.
Figure 6:
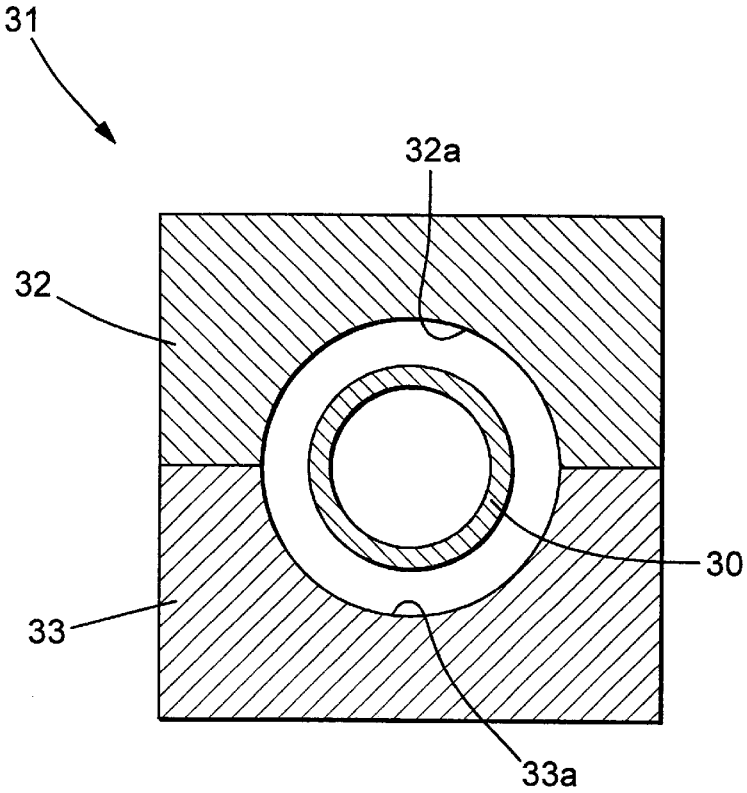
FIG. 6 is a sectional elevational view of the hydroforming die and exhaust tube blank taken along line 6—6 of FIG. 5.

The first and second tubes 11 and 12 are preferably formed to their desired shapes by hydroforming. As shown in FIGS. 5 and 6, a closed channel structural member, such as a tube 30, is disposed within-a hydroforming die, indicated generally at 31, that is composed of a first die section 32 and a second die section 33. As is well known, the die sections 32 and 33 have respective cavity portions 32*a* and 33*a* formed therein that cooperate to form a hydroforming die cavity when the die sections 32 and 33 are moved into engagement with one another as shown. Although the method of this invention will be explained and illustrated in conjunction with the illustrated linearly extending tube 30, it will be appreciated that this invention may be practiced with a tube that has been pre-bent, such as in a-conventional tube bending apparatus, to have one or more bends therein. The inner surface of the die cavity of the hydroforming die 31 may have any desired cross sectional shape.

Figure 7:
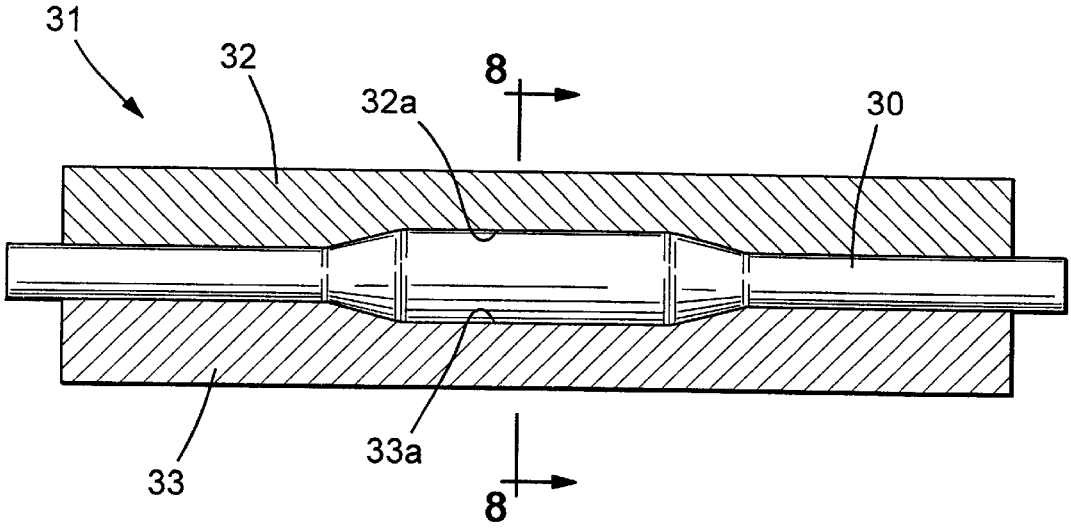
FIG. 7 is a sectional elevational view of the hydroforming die and the exhaust tube blank shown after expansion.
Figure 8:
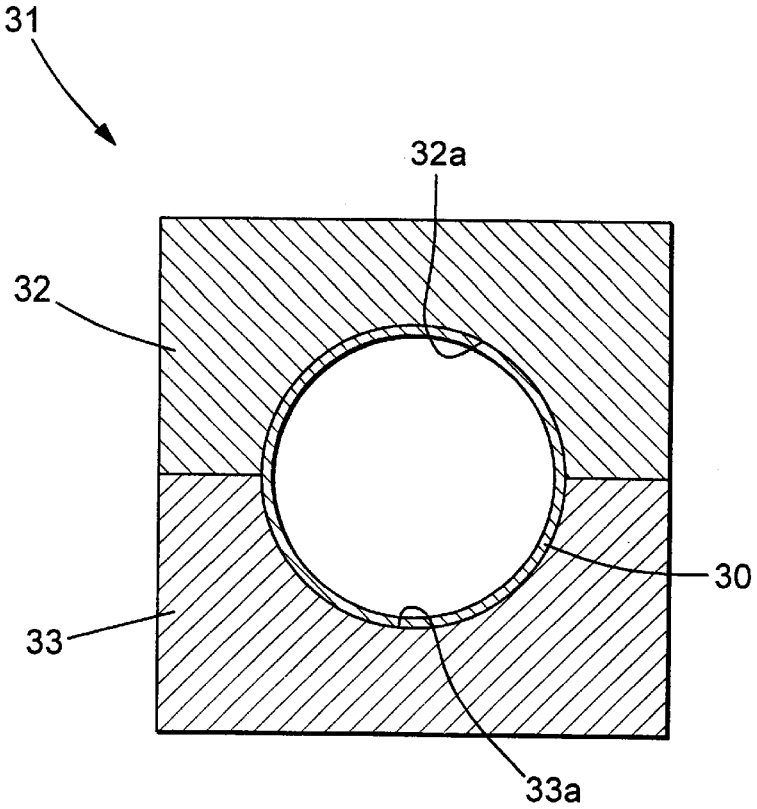
FIG. 8 is a sectional elevational view of the hydroforming die and the exhaust tube blank taken along line 8—8 of FIG. 7.

FIGS. 7 and 8 show the tube 30 after the completion of the hydroforming operation. The hydroforming operation is, of itself, conventional in the art and uses pressurized fluid to deform and/or expand the tube 30 into conformance with the die cavity of the hydroforming die 31. To accomplish this, the tube 30 is filled with a pressurized fluid, typically a relatively incompressible liquid such as water. The pressure of the fluid is increased to a magnitude where the tube 30 is deformed outwardly into conformance with the die cavity. As a result, the tube 30 is deformed into the shape illustrated in FIGS. 7 and 8. Any conventional apparatus may be used to perform the hydroforming operation. The hydroforming operation can be effective to increase the perimeter of the central portion of the tube 30 to correspond with the perimeter of the central portion of the die cavity of the hydroforming die 31. Because of this, the wall thickness of the central portion of the tube 30 may be decreased to a wall thickness that is somewhat less than the original wall thickness, although such is not necessary. The enlarged central portion of the tube 30 can then be cut into two portions to provide the first and second tubes 11 and 21 having the respective enlarged end portions, as shown in FIGS. 1 through 4.

Figure 9:
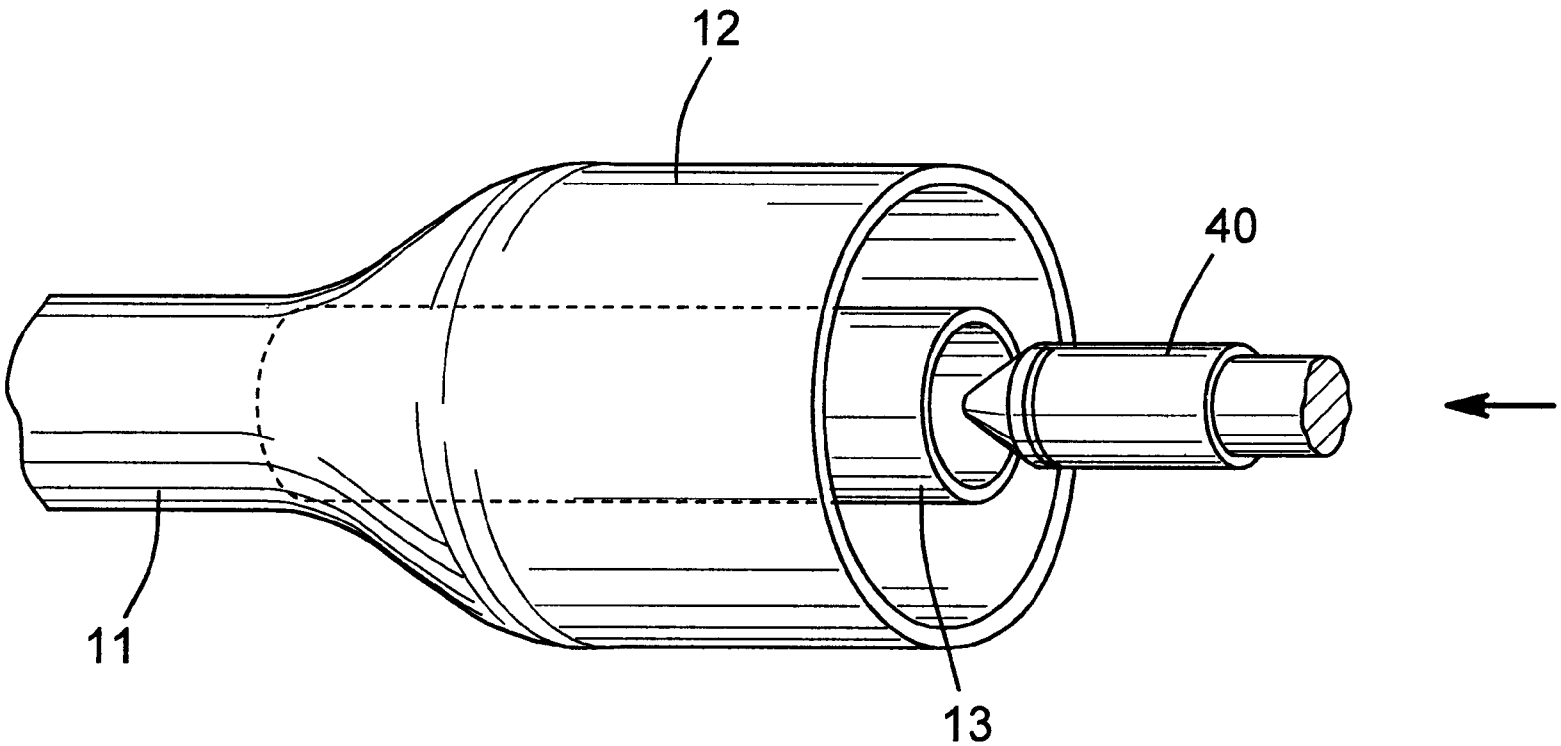
FIG. 9 is a perspective view of showing the method in which the first portion of the vehicle exhaust system illustrated in FIGS. 1 and 2 is assembled.

As mentioned above, the first retainer tube 13 may be secured to the first tube 11 by magnetic pulse welding. FIG. 9 illustrates a method for accomplishing this task. As shown therein, the first retainer tube 13 is initially positioned within the enlarged end portion 12 such that the end of the first retainer tube 13 abuts or is positioned adjacent to the smaller diameter portion of the first tube 11. Thus, a portion of the end of the first retainer tube 13 is positioned concentrically within a portion of the first tube 11. Then, an internal magnetic pulse welding inductor assembly 40 is inserted telescopically within the first retainer tube 13 (see arrow in FIG. 9) so as to be disposed concentrically within the telescopically overlapping portions of the first retainer tube 13 and the first tube 11. The magnetic pulse welding inductor assembly 40 is generally conventional in the art and includes an electromagnetic coil that is carried at the end of a movable support. The coil is composed of a winding of an electrical conductor having leads that extend therefrom through a switch (not shown) to a source of electrical power (not shown). In a manner that is known in the art, when the switch is closed, a closed electrical circuit is formed through the leads between the source of electrical power and the coil. As a result, electrical current flows through the coil, causing an intense electromagnetic field to be generated thereabout. The presence of this electromagnetic field causes the end of the first retainer tube 13 to expand outwardly at a high velocity into engagement with the surrounding portion of the first tube 11. Such high velocity engagement causes portions of the end of the first retainer tube 13 and the first tube 11 to weld or molecularly bond together, such as shown at W in FIG. 9. Thus, the first retainer tube 13 is secured to the first tube 11 by magnetic pulse welding.

Figure 10:
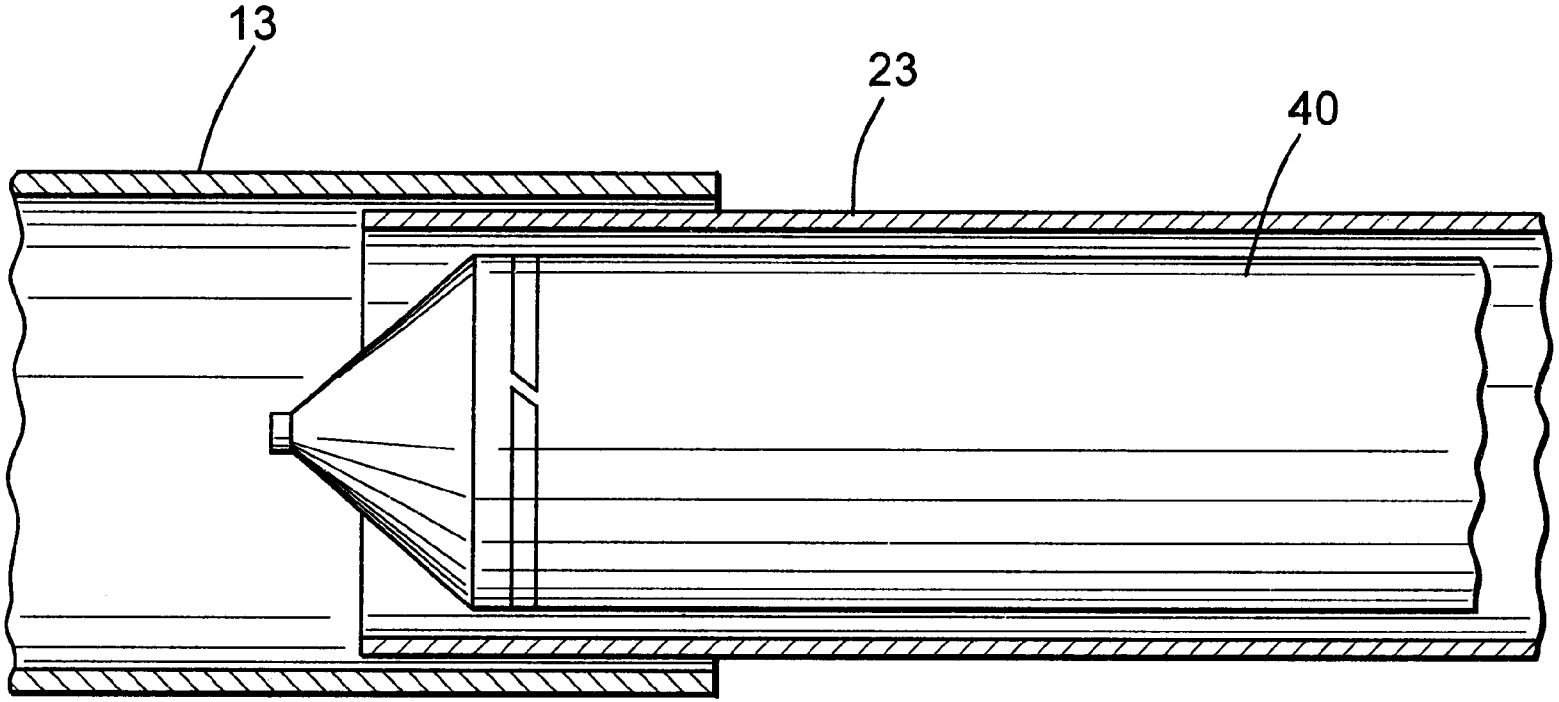
FIG. 10 is a sectional elevational view showing the method in which the first and second retainer tubes illustrated in FIGS. 1 through 4 are assembled.

As also mentioned above, the first retainer tube 13 may be secured to the second retainer tube 23 by magnetic pulse welding. FIG. 10 illustrates a method for accomplishing this task. As shown therein, the second retainer tube 23 is initially positioned concentrically within the first retainer tube 13. Then, the magnetic pulse welding inductor assembly 40 is inserted telescopically within the second retainer tube 23 so as to be disposed concentrically within the telescopically overlapping portions of the first and second retainer tubes 13 and 23. The magnetic pulse welding inductor assembly 40 is then operated in the manner described above to secure the first retainer tube 13 to the second retainer tube 23 by magnetic pulse welding. The other end of the second retainer tube 23 may be secured to the second tube 21 by magnetic pulse welding in a manner similar to that described above in connection with the first tube 11 and the first retainer tube 13.

Lastly, as mentioned above, the enlarged end of the first tube 11 may be secured to the enlarged end of the second tube 21 by magnetic pulse welding. This can be accomplished by positioning the enlarged end portion of the second tube 21 concentrically within the enlarged end portion of the first tube 11. Then, an external magnetic pulse welding inductor assembly (not shown) is disposed concentrically about the concentrically arranged enlarged end portions of the first and second tubes 11 and 12. The external magnetic pulse welding inductor assembly is conventional in the art and includes a coil that can be disposed about the concentrically arranged enlarged end portions of the first and second tubes 11 and 12. When the coil is energized, electrical current causes an intense electromagnetic field to be generated thereabout. The presence of this electromagnetic field causes the enlarged end portion of the first tube 11 to deform inwardly at a high velocity into engagement with the enclosed enlarged end portion of the second tube 21. Thus, the enlarged end portion of the first tube 11 is secured to the enlarged; end portion of the second tube 21 by magnetic pulse welding.

As mentioned above, the first tube 11 may have one or more connection flanges 14 connected thereto by means of respective mounting surfaces 15. The mounting surfaces 15 can be formed in any desired manner, but are preferably formed during the above-described hydroforming process if desired. The connection flanges 14 can be connected to the mounting surfaces 15 in any desired manner, but are preferably connected to such mounting surfaces 15 by magnetic pulse welding, as described above.

The chamber formed in the exhaust system 10 by the above discussed method can be configured for use either as a muffler or as a container for a catalytic converter. A simple muffler can be fabricated by providing a series of perforations of various sizes and shapes in the retainer tubes 13 and 23 to permit the expansion of exhaust gases into the exhaust chamber. Further deadening of the sound generated can be provided by packing sound deadening material, such as fiberglass, into the space around the retainer tube. Further sound deadening can be provided by varying the shape and curvature of the retaining tubes 13 and 23 to form a series of baffles, sub-chambers, and the like (not illustrated) to attenuate a specific frequency range or ranges as is well known in the art. Sound deadening material can be added to some or all of these sub-chambers. All such variations are specifically included in this invention.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A vehicular exhaust system comprising:

a flange adapted for connection to an exhaust manifold of an engine of a vehicle;

a first exhaust tube having a first end connected to said flange and a second end expanded to form an exhaust chamber;

a second exhaust tube having a first end expanded to form an exhaust chamber closure and a second end open to atmosphere, said exhaust chamber closure configured to fit inside said exhaust chamber, thereby joining said first exhaust tube with said second exhaust tube;

a retainer tube connected at said second end of said first exhaust tube at a point immediately before said second end of said first exhaust tube expands to form said exhaust chamber, said retainer tube extending through said exhaust chamber; and a retainer tube closure connected at said first end of said second exhaust tube at a point immediately before said first end of said second exhaust tube expands to form said exhaust chamber closure, said retainer tube closure extending through said exhaust chamber closure and configured to fit inside said retainer tube.

2. The vehicular exhaust system of claim 1 where said exhaust chamber contains sound deadening material.

3. The vehicular exhaust system of claim 1 where said retainer tube and said retainer tube closure are perforated to permit expansion of exhaust gases into said exhaust chamber.

4. The vehicular exhaust system of claim 1 where said exhaust chamber is configured to form the case for a catalytic converter.

5. The vehicular exhaust system of claim 1 where said retaining tube is curved to form a series of baffles and sub-chambers in said exhaust chamber.

6. The vehicular exhaust system of claim 1 further comprising brackets and hangers pre-formed on said first exhaust tube and said second exhaust tube.

7. The vehicular exhaust system of claim 1 where said vehicle exhaust system is formed from metals or alloys of metals chosen from the group consisting of steel, aluminum, and magnesium.

8. The vehicular exhaust system of claim 1 where said vehicle exhaust system is formed from different metals or alloys of metals chosen from the group consisting of steel, aluminum, and magnesium.

9. The vehicular exhaust system of claim 1 where said exhaust chamber closure and said exhaust chamber and said retainer tube closure and said retainer tube are separated by 1–3 mm, respectively.

10. A method for manufacturing a vehicle exhaust system comprising the steps of:

pre-bending a first exhaust tube having a first end and a second end;

pre-bending a second exhaust tube having a first end and a second end;

hydroforming said second end of said first exhaust tube to form an exhaust chamber;

hydroforming said first end of said second exhaust tube to form an exhaust chamber closure configured to fit inside said exhaust chamber; and securing using magnetic pulse welding said exhaust chamber closure inside said exhaust chamber.

11. The method defined in claim 10 after hydroforming said second end of said first exhaust tube and said first end of said second exhaust tube further comprising the steps of:

securing using magnetic pulse welding a retainer tube at said second end of said first exhaust tube at a point immediately before said second end of said first exhaust tube expands to form said exhaust chamber, said retainer tube extending through said exhaust chamber;

securing using magnetic pulse welding a retainer tube closure connected at said first end of said second exhaust tube at a point immediately before said first end of said second exhaust tube expands to form said exhaust chamber closure, said retainer tube closure extending through said exhaust chamber closure and configured to fit inside said retainer tube; and securing using magnetic pulse welding said exhaust chamber closure inside said exhaust chamber and said retainer tube closure inside said retainer tube.

12. The method defined in claim 10 further comprising the step of adding sound deadening material to said exhaust chamber prior to securing said exhaust chamber closure in said exhaust chamber.

13. The method defined in claim 11 further comprising the step of perforating said retainer tube and said retainer tube closure to permit expansion of exhaust gases into said exhaust chamber prior to securing using magnetic pulse welding said exhaust chamber closure inside said exhaust chamber and said retainer tube closure inside said retainer tube.

14. The method defined in claim 10 further where said exhaust chamber is configured to form a case for a catalytic converter.

15. The method defined in claim 11 where said retaining tube is curved to form a series of baffles and sub-chambers in said exhaust chamber.

16. The method defined in claim 10 where brackets and hangers are preformed during said hydroforming steps on said first exhaust tube and said second exhaust tube.

17. The method defined in claim 10 where said vehicle exhaust system is formed from metals or alloys of metals chosen from the group consisting of steel, aluminum, and magnesium.

18. The method defined in claim 10 where said vehicle exhaust system is formed from different metals or alloys of metals chosen from the group consisting of steel, aluminum, and magnesium.

19. The method defined in claim 11 where said exhaust chamber closure and said exhaust chamber and said retainer tube closure and said retainer tube are separated by 1–3 mm, respectively.

20. A vehicular exhaust system comprising:

a first exhaust tube having a first end and a second end that is expanded relative to said first end;

a second exhaust tube having a first end and a second end that is expanded relative to said first end, said second end of said first exhaust tube and said second end of said second exhaust tube being joined together to define an exhaust chamber;

a first retainer tube disposed within said exhaust chamber and having a first end that is connected to said first end of said first exhaust tube and a second end; and a second retainer tube disposed within said exhaust chamber and having a first end that is connected to said first end of said second exhaust tube and a second end, said second end of said first retainer tube and said second end of said second retainer tube being joined together to define a fluid conduit from said first end of said first exhaust tube through said exhaust chamber to said first end of said second exhaust tube.

21. A method for manufacturing a vehicle exhaust system comprising the steps of:

providing first and second exhaust tubes, each having a first end and a second end that is expanded relative to said first end;

providing first and second retainer tubes, each having a first end and a second end;

joining the first end of the first retainer tube to the first end of the first exhaust tube;

joining the first end of the second retainer tube to the first end of the second exhaust tube;

joining the second end of the first exhaust tube and the second end of the second exhaust tube to define an exhaust chamber; and joining the second end of the first retainer tube to the second end of the second retainer tube to define a fluid conduit from the first end of the first exhaust tube through the exhaust chamber to the first end of the second exhaust tube.

* * * * *